US005568705A

United States Patent [19]

Bellavista

[11] Patent Number: 5,568,705

[45] Date of Patent: Oct. 29, 1996

[54] EARTHQUAKE RESISTANT MOUNTS FOR BUILDINGS AND CONSTRUCTIONS

[76] Inventor: Patrice Bellavista, BP 2022, 84023 Avignon Cedex 7, France

[21] Appl. No.: 368,273

[22] Filed: Dec. 22, 1994

Related Application Data

[63] Continuation of PCT/FR93/00626, Jun. 23, 1993, published as WO94/00658, Jan. 6, 1994.

[30] Foreign Application Priority Data

Jun. 23, 1992 [FR] France ..... 92 07991

[51] Int. Cl.[6] ..... E04H 9/02

[52] U.S. Cl. ..... 52/167.1; 52/573.1

[58] Field of Search ..... 52/573, 167.1, 52/167.4

[56] References Cited

U.S. PATENT DOCUMENTS 5,131,195 7/1992 Bellavista ..... 52/167.1

FOREIGN PATENT DOCUMENTS 0411876 2/1991 European Pat. Off. .
8802647 U 5/1988 Germany .

*Primary Examiner*—Carl D. Friedman
*Assistant Examiner*—Beth A. Auber
*Attorney, Agent, or Firm*—Horst M. Kasper

[57] ABSTRACT

An earthquake resistant mount is made up of two monoblock elements of a hard rotproof material possessing great resistance to abrasion for supporting buildings and constructions. The earthquake resistant mount is secured to the infrastructure and to the superstructure of the building. A first monoblock element is formed of a preferably circular horizontal rubbing plate including a cone frustrum at its center. A second monoblock element has the shape of a circular cap with a flat blind end and covers the first element so that said blind end of the concavity is in contact with the horizontal plane situated at the top of the cone frustrum, and the horizontal peripheral edge is in contact with the rubbing plate. An annular space is furnished between the internal lateral wall of the circular cap and the lateral wall of the cone frustrum, and the horizontal peripheral edge is in contact with the rubbing plate. The annular space between the internal lateral wall of the cone frustrum allows a relative lateral displacement and of at least one damping ring secured or not secured to the internal lateral wall of the circular cap and/or the lateral wall of the cone frustrum. The damping ring fills all or some of said annular space. A layer of a resilient and crush-resistant polymer is interposed horizontally at any level through the entire thickness of the material of said elements. The layer allows to absorb low-amplitude tremors before the monoblock elements slip.

19 Claims, 2 Drawing Sheets

EARTHQUAKE RESISTANT MOUNTS FOR BUILDINGS AND CONSTRUCTIONS

This is a continuation of PCT/FR93/00626, filed Jun. 23, 1993 and published as WO94/00658 Jan. 6, 1994.

FIELD OF THE INVENTION

The subject of the present invention is earthquake resistant mounts for buildings and constructions, interposed between an infrastructure secured to the ground and a superstructure.

BACKGROUND OF THE INVENTION

These mounts, true earthquake resistant supports, are mainly composed of two detached monoblock elements and are intended to be interposed between the infrastructure and the superstructure of all sorts of buildings and erected constructions, for the purpose of allowing these constructions to avoid being subjected to the effects of the most violent earthquake attacks.

The earthquake resistant devices known to date are of two distinct types: they are either based on a possibility of sliding with friction allowing limited displacement, or designed on the basis of elastomeric blocks, often hooped, the distortion of which is put to use. In the first case displacement of the building is not damped out and substantial lateral displacements may give rise to extremely high impacts which may be the cause of breakage of the earthquake resistant device itself, or even of the building to be protected. The characteristics of natural or synthetic elastomeric blocks, hooped in the second case, change over time, which logically should lead to them being replaced periodically, and what is more these devices do not make it possible to control completely the amplitude of the movements due to the earth tremors.

The devices described in the French Patent Letters 2,625,763, 2,601,716 and in the U.S. Pat. No. 5,131,195 filed by the same inventor partly eliminate these drawbacks.

Indeed, they make it possible, at the same time, to damp out both vertical and lateral movements brought about by an earthquake, and to control the amplitude of these movements, while braking them. Furthermore, they are made up of materials which are extremely stable with time, and which perfectly resist differences in temperature, microorganisms, and chemical attack. These devices are made up of two monoblock elements produced from a hard, rotproof material, which has great resistance to abrasion, these elements being respectively secured to the infrastructure and to the superstructure of the building, the lower element being made up of a horizontal rubbing plate including a cone frustum at its center, the upper element being made up of a circular cap having its concavity pointing towards the bottom and capping the lower element so that the blind end of the concavity rests on the top of the cone frustum and the lower edges rest on the rubbing plate of the lower element, an annular space between the two elements allowing relative lateral displacement, said elements being supplemented by one or two rings made from a material which is also rotproof and has high impact-damping characteristics, these rings being secured to the internal lateral wall of the upper element and/or to the lateral wall of the cone frustum of the lower element and filling all or some of the annular space.

However, the design of these devices means that they are not very effective for earthquakes having an amplitude of less than 0.2 on the Richter scale. This is due to the coefficient of friction of the materials used, which index hitherto has been close to 0.2. Now, current legislation requires a coefficient of less than or equal to 0.05 for this type of device, precisely so that they are capable of acting even for tremors of very low amplitude.

SUMMARY OF THE INVENTION

The present application relates to functional improvements made to French Patent Letters 2,625,763, 2,601,716 and in the U.S. Pat. No. 5,131,195 in order to extend their range of action to weak tremors.

These improvements consist, on the one hand, of mould-release silicons mixed with the polymer at the time of molding, mould-release polyurethanes and/or of films or projections or thicknesses of Kevlar or of aramid and derivatives with a very low coefficient of friction covering all or some of the rubbing surfaces of one or both elements and which can be placed inside the manufacturing moulds constituting the earthquake resistant mount and/or, on the other hand, of single or multiple layers of resilient polymer interposed horizontally at any level through the entire thickness of the material of the lower element and/or of the upper element, the deformation of these layers making it possible to absorb low-amplitude tremors without said elements sliding.

BRIEF DESCRIPTION OF THE DRAWINGS

In the appended drawings, given by way of non-limiting example of one of the embodiments of the subject of the invention.

DESCRIPTION OF THE PREFERRED EMBODIMENT

Figure 1:
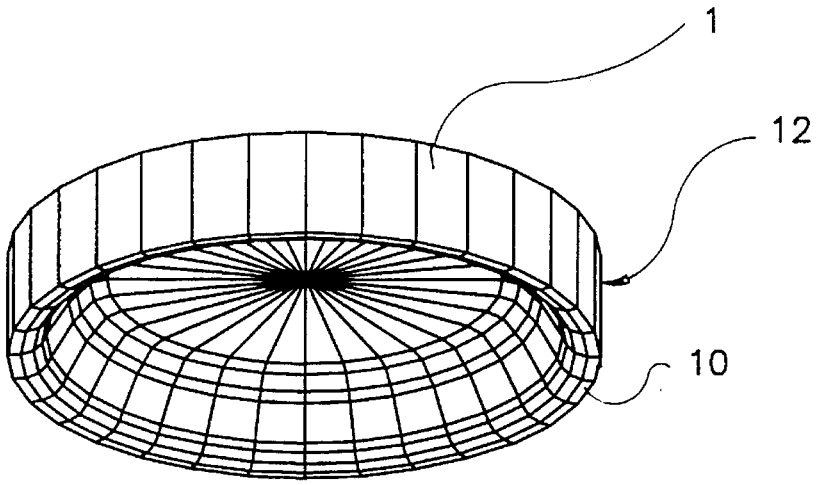
FIGS. 1 and 2 show in perspective the upper and lower elements, separated.
Figure 2:
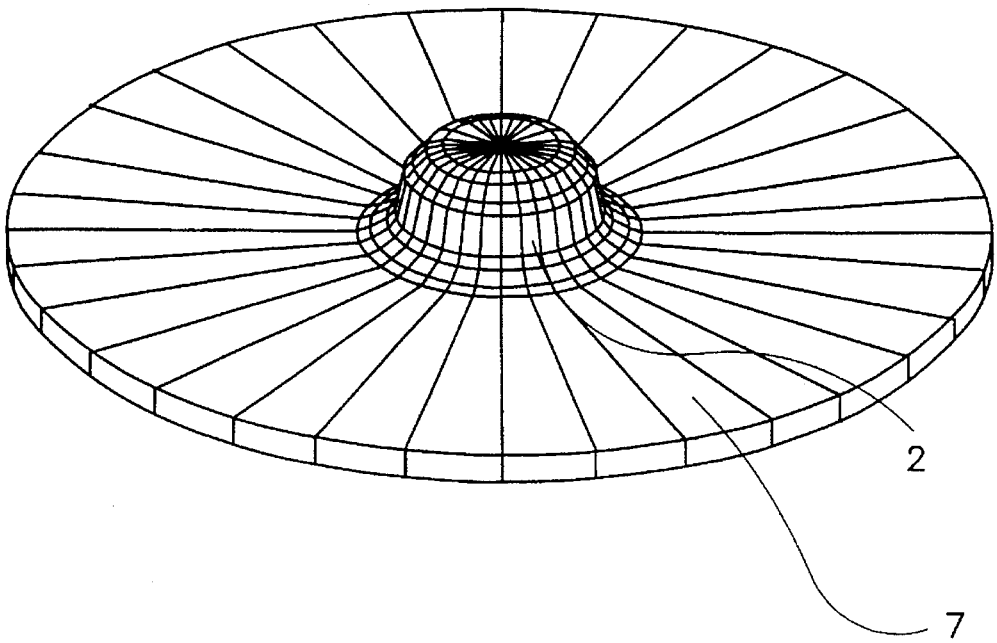
Figure 3:
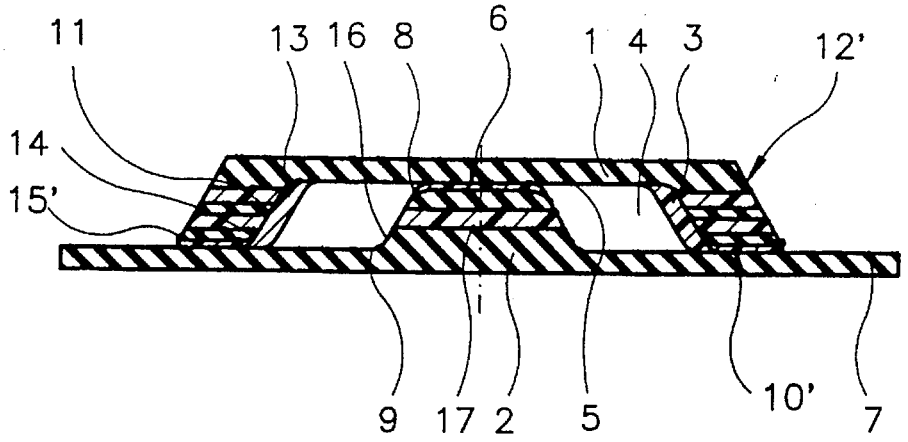
FIGS. 3, 4 and 5 represent transverse sections through three versions of the assembled device.
Figure 4:
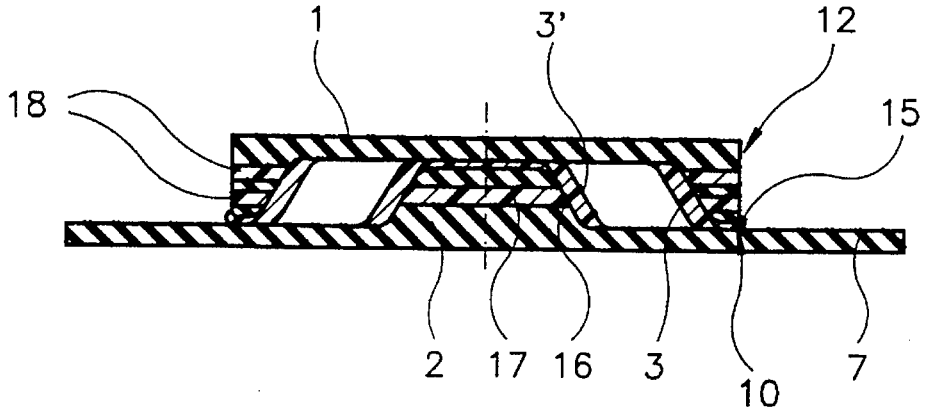
Figure 5:
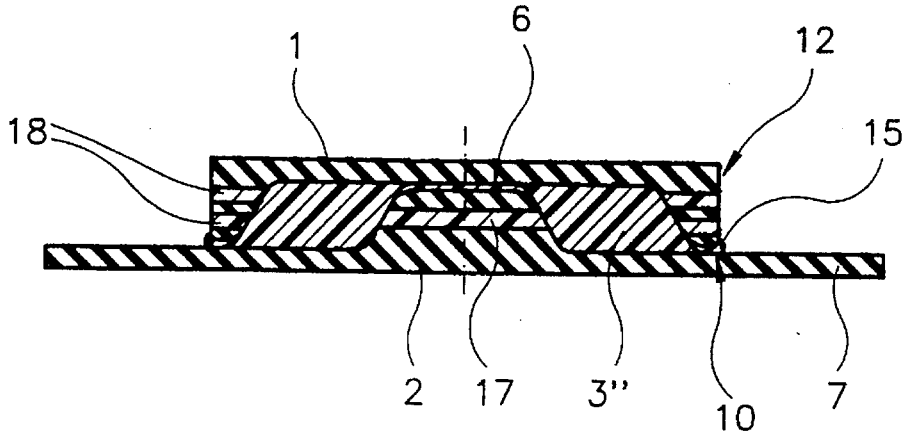

The device, FIGS. 1 to 5, is made up of an upper element 1 in the form of a cylindrical cap with a flat blind end 5, the hollow part of which points downwards, secured to the superstructure of the building, of a block or cone frustum 2 secured to the bearing surface, and of one or two damping rings 3, 3', 3" which are independent or secured to one or both elements 1, 2 and are situated in an annular space 4 formed between the lower cone frustum 2 and the upper cap 1.

The lower element 2 at its base includes a horizontal rubbing plate 7 on which the lower edge 10 of the upper element 1 rests. The angles 8, 9 of the lateral wall 16 of the block 2 with its upper horizontal surface 6 and with the plate 7 are rounded in order to prevent breakage initiators and a scraping effect during lateral displacements. For the same reasons, the angles 13, 14, 15, 15' formed by the internal 11 and external 12, 12' lateral walls of the upper element 1 with the blind end 5 or the lower edge 10 of said element are also rounded.

The damping ring 3 is secured to the internal lateral wall 11 of the upper element 1, while the ring 3' is secured to the lateral wall 16 of the lower block 2. These two rings may be replaced by a single ring 3" secured to the lateral walls of the upper 11 and lower 16 elements, or to one of them, or yet again may be totally independent and possibly distant from the parts 13, 11, 14 of the upper element 1 and/or the parts 8, 16, 9 of the lower element 2, the rest filling all of the intermediate annular space 4 as need be. The ring 3" must be able to distort easily, taking the phenomenon of natural flow of polymers into account.

In order to decrease the coefficient of friction, the contacting horizontal surfaces 5, 6 and 10, 7 as well as any other surfaces which may possibly come into contact when the two elements 1 and 2 slip relative to one another may be coated with mould-release silicones which are included at the time of molding and/or with mould-release polyurethanes and/or with films or projections or thicknesses of Kevlar or aramid fibre or derivatives having a very low coefficient of friction. These various coatings may be provided on the surfaces of both elements 1, 2 or on just one and may be applied to the insides of the moulds during manufacture.

The absorption of low-amplitude tremors may be obtained before the elements 1 and 2 slip by virtue of single or multiple layers 17, 18 of resilient polymer interposed horizontally at any level through the entire thickness of material of the lower element 2 and/or upper element 1, it being possible for one or more thicknesses of resilient polymer to be or not be the same thickness over an identical level in the elements 1 and 2, the distortion of one or more layers making it possible for low-amplitude tremors to be absorbed before said elements slip.

The absorption of weak tremors before the elements 1, 2 slip is also obtained through distortion of the damping rings 3, 3', 3" as well as the single or multiple horizontal layers 17, 18.

The lateral walls 12, 12' of the upper element 1 can either be vertical 12, or have some inclination 12' in the same direction as the cone 2, forming a frustoconical peripheral surface and serving to increase the strength of the assembly 1, thus increasing the contact surface of the lower edge 10' of the bottom of the upper element 1, also facilitating the mould-release of the poured components. The outside angle 15' of the base 10' forming a junction with the oblique side 12' remains rounded.

In all cases, the overhang of the larger plate 7 relative to the base 10, 10' is in all directions equal to 1.5 times the maximum amount of slip, calculated over 360° of surface area.

The lower element 2 and upper element 1 may be reversed and inverted, that is to say that the cylindrical or frustoconical cap 1 is integral with the bearing surface and located at the bottom with the hollow part pointing upward, while the block or cone frustum 2 is secured to the superstructure of the building and located at the top, the position of all the mounts having to be the same for all the elements for one and the same construction. The only distinguishing features to differentiate the direction of use of the elements, the nomenclature right way up or upside down, consisting of lettering visible as a projection and cast into the mass upon manufacture of the elements, and specifications noted on all documents representing them.

The earthquake resistant mount described favorably alters the dynamic behavior of structures relative to earthquakes, it is made without hooping with any ferruginous material.

By associating just one type of extremely mechanically strong polymer, alternating with more resilient polymers which resist crushing, a substantial displacement in terms of rocking is allowed, then through controlled slippage over 360° and internally including a system with return force, thereby resuming its initial position after stressing, giving a coefficient of friction whose variations are negligible in space and in time.

The positioning of the various constituent elements gives the subject of the invention maximum useful effect which, hitherto, had not been obtained by similar devices.

What we claim is:

1. An earthquake resistant mount for buildings and constructions comprising two monoblock elements of a hard rotproof material possessing great resistance to abrasion, and being secured respectively to the infrastructure and to the superstructure of the building, one of these elements being formed of a preferably circular horizontal rubbing plate including a cone frustum at its center, the second element having the shape of a circular cap with a flat blind end which caps the first element so that said blind end of the concavity is in contact with the horizontal plane situated at the top of the cone frustum, and the horizontal peripheral edge in contact with the rubbing plate, an annular space between the internal lateral wall of the circular cap and the lateral wall of the cone frustum allowing relative lateral displacement;

at least one damping ring secured or not secured to the internal lateral wall of the circular cap and/or to the lateral wall of the cone frustum, filling all or some of said annular space; and single or multiple layers of a resilient polymer which resists crushing, making it possible to absorb low-amplitude tremors before the monoblock elements slip, are interposed horizontally at any level through the entire thickness of the material of said elements, it being further possible for these layers of resilient polymer to be or not to be of the same thickness over an identical level in the two elements.

2. The device according to claim 1 wherein the horizontal surfaces in contact with one or both monoblock elements, as well as any surfaces which may possibly come into contact during the relative slipping of these two elements, are completely or partly coated with one or more products making it possible to obtain a coefficient of friction less than or equal to 0.05.

3. The device according to claim 2 wherein the product or products acting on the coefficient of friction is (are) chosen from among the following products:

mould-release silicones, mould-release polyurethanes, films or projections of Kevlar or derivatives, films or projections of aramid or derivatives.

4. The device according to claim 1 wherein the angles of the lateral wall of the cone frustum with its upper horizontal surface and with the rubbing plate, as well as the angles formed by the internal lateral walls and external lateral walls of the circular cap with the blind end or the peripheral edge of the latter are rounded so as to avoid the breakage initiators and a scraping effect during lateral displacements.

5. The device according to claim 1 wherein the external lateral walls of the circular cap are inclined relative to the vertical in the same direction as the walls of the cone frustum, forming a frustoconical peripheral surface increasing the strength of said circular cap as well as the contact surface of the peripheral edge and also facilitating the mould-release of the poured components, the overhang of the rubbing plate relative to said peripheral edges being in all cases equal to 1.5 times the maximum amount of slip calculated over 360° of surface area in all directions.

6. The device according to claim 1 wherein a single damping ring which is not secured to the internal lateral wall of the circular cap nor to the lateral wall of the cone frustum is located in the annular space formed between said cone frustum and said circular cap, said cone filling or not filling all of said annular space.

7. The device according to claim 1 wherein the monoblock element formed by the horizontal rubbing plate and the cone frustum is at the bottom and is secured to the bearing surface, while the monoblock element made up of a circular cap is at the top and is secured to the superstructure of the building.

8. The device according to claim 1 wherein the monoblock element formed by the horizontal rubbing plate and the cone frustum is at the top and is secured to the superstructure of the building, while the monoblock element made up of a circular cap is at the bottom and is secured to the bearing surface.

9. An earthquake resistant mount for buildings and constructions, these being made up, on the one hand, of two monoblock elements of a hard rotproof material possessing great resistance to abrasion, and being secured respectively to an infrastructure and to a superstructure of the building, wherein a first one of these monoblock elements is formed of a preferably circular horizontal rubbing plate including a cone frustrum at its center, and wherein a second one of these monoblock elements has a shape of a circular cap with a flat blind end which caps the first one of the monoblock elements so that said flat blind end of the concavity is in contact with a horizontal plane situated at a top of the cone frustrum, and the horizontal peripheral edge in contact with the rubbing plate, an annular space between an internal lateral wall of the circular cap and a lateral wall of the cone frustrum allowing relative lateral displacement and, on the other hand, of at least one damping ring secured or not secured to the internal lateral wall of the circular cap and/or the lateral wall of the cone frustrum, filling all or some of said annular space, wherein multiple layers of polymers, having different resilience coefficients, which layers resist crushing, making it possible to absorb low-amplitude tremors before the monoblock elements slip, are interposed horizontally at any level through the entire thickness of the material of said monoblock elements, it being further possible for these multiple layers of resilient polymer to be or not to be of the same thickness over an identical level in the two monoblock elements.

10. The device according to claim 9 wherein the horizontal surfaces in contact during the relative slipping of said monoblock elements are coated with a material chosen from among the mold-release silicones, the mold-release polyurethanes, the films or projections of Kevlar or derivatives, the film or projections of aramid or derivatives, and a combination thereof.

11. An earthquake resistant insulator for buildings capable of being interposed between the ground and erected buildings to permit a building to avoid effects of violent earth tremors by absorbing vertical movements as well as lateral movements caused by tremors, and to control and reduce the amplitude of these movements, comprising a first monoblock element composed of a hard, rot-resistant material, possessing high resistance to abrasion and including a horizontal friction plate having at its center a truncated cone;

a first layer of resilient polymer resistant to crushing for absorbing low-amplitude tremors interposed in the first monoblock element at a horizontal level through the entire thickness of said first monoblock element;

a second monoblock element, independent of the first monoblock element, composed of a hard, rot resistant material, possessing high resistance to abrasion and including a circular cap with a flat bottom and a concavity directed towards and covering said first monoblock element so that said flat bottom rests on an uppermost portion of said truncated cone and remote edges of said circular cap on said friction plate of said first monoblock element, a second layer of resilient polymer resistant to crushing for absorbing low-amplitude tremors before the second monoblock element slips relative to the first monoblock element and interposed in the second monoblock element at a horizontal level through the entire thickness of said second monoblock element;

an annular space between a lateral wall portion of said second monoblock element and an opposing lateral wall portion of said truncated cone of said first monoblock element allowing relative lateral movement; and at least one absorbing collar composed of a material that is not resistant and possesses high shock absorption characteristics, said at least one absorbing collar being mounted on at least one of said lateral wall portion of said second monoblock element and said opposing lateral wall portion of said truncated cone of said first monoblock element, and filling at least a portion of said annular space.

12. The earthquake resistant insulator according to claim 11, further comprising a coating placed on a horizontal surface of said flat bottom, wherein the coating is a member of the group consisting of
mold-release silicones,
mold-release polyurethanes,
films of Kevlar, projections of Kevlar,
films of aramids,
projections of aramids, and mixtures thereof.

13. The earthquake resistant insulator according to claim 11, further comprising a coating placed on the uppermost portion of said truncated cone, wherein the coating is a member of the group consisting of
mold-release silicones,
mold-release polyurethanes,
films of Kevlar, projections of Kevlar,
films of aramids,
projections of aramids, and mixtures thereof.

14. The earthquake resistant insulator according to claim 11, further comprising a coating placed on the lower edges of said circular cap, wherein the coating is a member of the group consisting of
mold-release silicones,
mold-release polyurethanes,
films of Kevlar, projections of Kevlar,
films of aramids,
projections of aramids, and mixtures thereof.

15. The earthquake resistant insulator according to claim 11, further comprising a coating placed on the friction plate, wherein the coating is a member of the group consisting of
mold-release silicones,
mold-release polyurethanes,
films of Kevlar, projections of Kevlar,
films of aramids,
projections of aramids, and mixtures thereof.

16. The earthquake resistant insulator according to claim 1, wherein the first monoblock element is a lower monoblock element having the horizontal friction plate and a cone frustrum of the truncated cone at the bottom, and wherein the second monoblock element is an upper monoblock element having the circular cap disposed at the top, and wherein the remote edges are lower edges, and wherein the second monoblock element is secured to a superstructure of a building.

17. The earthquake resistant insulator according to claim 11, wherein the first monoblock element is an upper monoblock element having the horizontal friction plate and a cone frustrum of the truncated cone at the top, and wherein the second monoblock element is a lower monoblock element having the circular cap disposed at the bottom, and wherein the remote edges are upper edges, and wherein the second monoblock element is secured to a bearing surface.

18. The earthquake resistant insulator according to claim 11, wherein angles of a lateral wall of a frustrum of the truncated cone with its upper horizontal surface and with the friction plate, as well as angles formed by internal lateral walls and external lateral walls of the circular cap with a blind end or a peripheral edge of the blind end, are rounded in order to avoid a presence of breakage initiators and a scraping effect during lateral displacements.

19. The earthquake resistant insulator according to claim 11, wherein external lateral walls of the circular cap are inclined relative to a vertical direction in the same direction as walls of the frustrum of the truncated cone, thereby forming a frustroconical peripheral surface increasing the strength of said circular cap as well as a contact surface of a peripheral edge and also facilitating a mold-release of poured components, wherein an overhang of the friction plate relative to said peripheral edges is in all cases equal to 1.5 times a maximum amount of slip as calculated over 360° of surface area in all directions.

* * * * *